US005373963A

United States Patent [19]

Hsu

[11] Patent Number: 5,373,963

[45] Date of Patent: Dec. 20, 1994

[54] NEWSPAPER VENDING MACHINE

[76] Inventor: Tsang-Hung Hsu, 4F. No. 37, Min Tsu St., Chung Hsun Tsun, Kuei Shan Hsiang, Tao Yuan Hsien, Taiwan, Prov. of China

[21] Appl. No.: 181,151

[22] Filed: Jan. 12, 1994

[51] Int. Cl.[5] ..... B65H 7/00; G07F 11/00

[52] U.S. Cl. ..... 221/17; 221/110; 221/133; 221/213; 221/244; 221/258; 221/155; 221/277; 221/130

[58] Field of Search ..... 221/6, 17, 110, 124, 221/133, 213, 217, 244, 258, 277, 155, 130

[56] References Cited

U.S. PATENT DOCUMENTS 2,546,352 3/1951 Weaver ..... 221/6
2,576,636 11/1951 Opgenorth ..... 221/213
3,708,087 1/1973 Schonthal ..... 221/155
4,473,172 9/1984 Reynolds ..... 221/213
5,137,134 8/1992 La Spina et al. ..... 221/213

*Primary Examiner*—H. Grant Skaggs
*Attorney, Agent, or Firm*—Lowe, Price, LeBlanc & Becker

[57] ABSTRACT

A newspaper vending machine includes a newspaper let-off mechanism which is triggered to turn on a toothed on-way gyrostate causing it to send out one copy of the newspaper through a newspaper outlet when a coin is dropped in, and a sample copy release control mechanism which is triggered to release the sample copy when a coin is dropped in after the copies of the newspaper have been sold out.

2 Claims, 8 Drawing Sheets

NEWSPAPER VENDING MACHINE

BACKGROUND OF THE INVENTION

The present invention relates to a newspaper vending machine which uses a motor to turn on a toothed, one-way gyrostate causing it to send out one copy of the newspaper when a coin is dropped in, and which has a transparent front door for showing the banner-head line of the sample copy of the newspaper. The newspaper vending machine further comprises a sample copy release control mechanism which releases the sample copy of the newspaper permitting it to be sent out of the newspaper outlet when a coin is dropped in after all copies of the newspaper have been sold out.

Various vending machines have been disclosed and have been widely installed in street corners for vending any of a variety of things including canned beverage, magazines, etc. There is also known a newspaper vending machine from which one obtains one copy of a selected newspaper when a coin is dropped in. A conventional newspaper vending machine may include a mechanism which automatically gives a change when a bank-note is dropped in. When a coin is dropped in the coin slot on a conventional newspaper vending machine, the machine will open the door for permitting the purchaser to pick up one copy from a stack of copies of the newspaper being selected. Because the newspaper vending machine simply opens the door for letting the purchaser to pick up one copy from a stack of copies of a newspaper, it cannot stop people from taking more copies over the value of the coins they inserted. Further, conventional newspaper vending machines are commonly complicated and expensive.

SUMMARY OF THE INVENTION

The present invention has been accomplished to provide a newspaper vending machine which eliminates the aforesaid drawbacks. According to one aspect of the present invention, the newspaper vending machine comprises a newspaper let-off mechanism which is triggered to turn on a toothed, motor-driven gyrostate causing it to send out one copy of the newspaper through a newspaper outlet when a coin is dropped in.

According to another aspect of the present invention, the toothed, motor-driven gyrostate can be turned in idle when the motor is stopped so that the let-off copy of the newspaper can be pulled out of the newspaper outlet by the purchaser without causing a damage.

According to still another aspect of the present invention, the newspaper vending machine further comprises a sample copy release control mechanism which holds a sample copy of the newspaper behind the transparent front door-of the machine for showing the banner-head line of the newspaper, and which is triggered to release the sample copy when a coin is dropped in after the copies of the newspaper have been sold out.

According to still another aspect of the present invention, the newspaper vending machine has raised portions and recesses respectively disposed at different elevations so that a plurality of newspaper vending machine of the same structure can be connected in stack by fitting the raised portions on one newspaper vending machine into the recesses on another.

DETAILED DESCRIPTION OF THE PREFERRED EMBODIMENT

Figure 1:
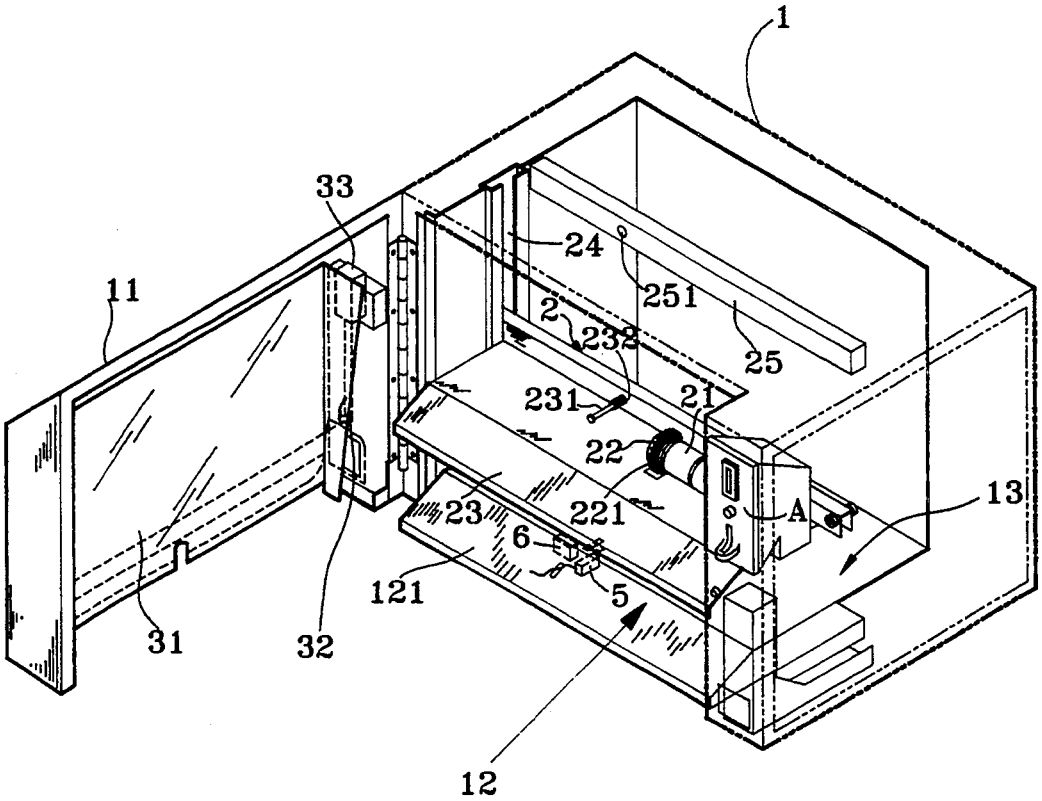
FIG. 1 is a perspective view of a newspaper vending machine according to the present invention.
Figure 7:
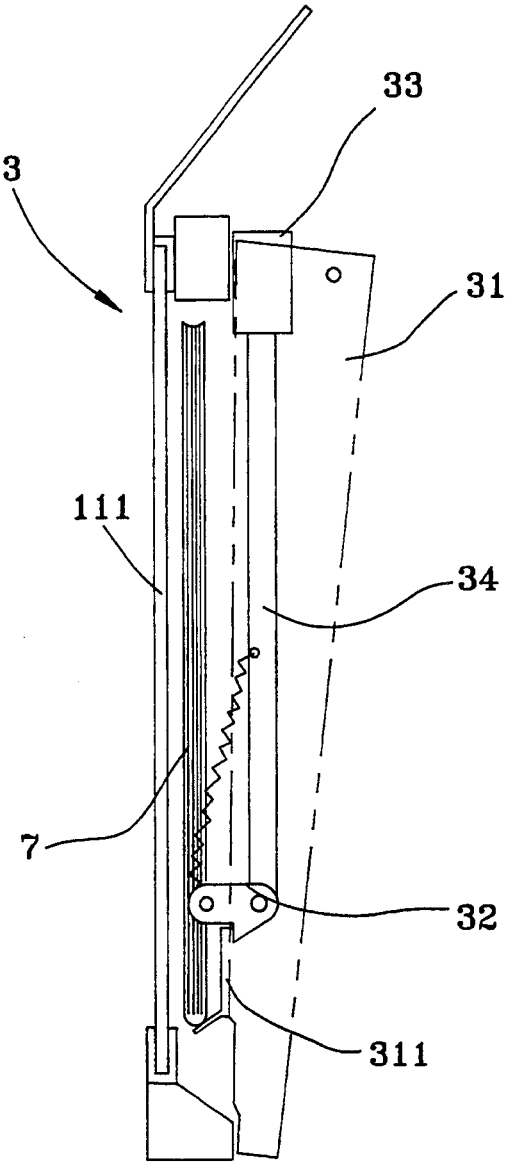
FIG. 7 is a side view of the sample copy release control mechanism showing the movable sample copy retaining plate hooked by the locating hook to hold the sample copy in place.

Referring to FIGS. 1 and 7, a newspaper vending machine in accordance with the present invention is generally comprised of cabinet 1 having a coin slot A. One copy of the newspaper being shown in the vending machine will be sent out when a coin is dropped in the coin slot A. A newspaper let-off mechanism 2 and a sample copy release mechanism 3 are respectively installed in the cabinet 1 on the inside. The cabinet 1 of the vending machine comprises a front door 11, a newspaper outlet 12 below the front door, a sloping guide 121 disposed in the newspaper outlet 12 at the bottom for guiding out copies of the newspaper, a storage chamber 13 on the inside for keeping a stack of copies of the newspaper. The newspaper let-off mechanism 2 comprises a motor 21, and an one-way gyrostate 22 driven by the motor 21 to carry one copy of the newspaper from the storage chamber 13 out of the newspaper outlet 12 when a coin is dropped in the coin slot A. The sample copy release control mechanism 3 comprises a movable sample copy retaining plate 31 closely attached to the front door 11 at the back by a locating hook 32 thereof to hold a sample copy of the newspaper. The front door 11 has a transparent door face 111 through which the banner-head line of the sample copy is viewed. The sample copy is released when a coin is dropped in after all copies of the newspaper in the storage chamber 13 have been sold out.

The aforesaid structural design is easy to maintain, its details may be made in the following manner.

Figure 2:
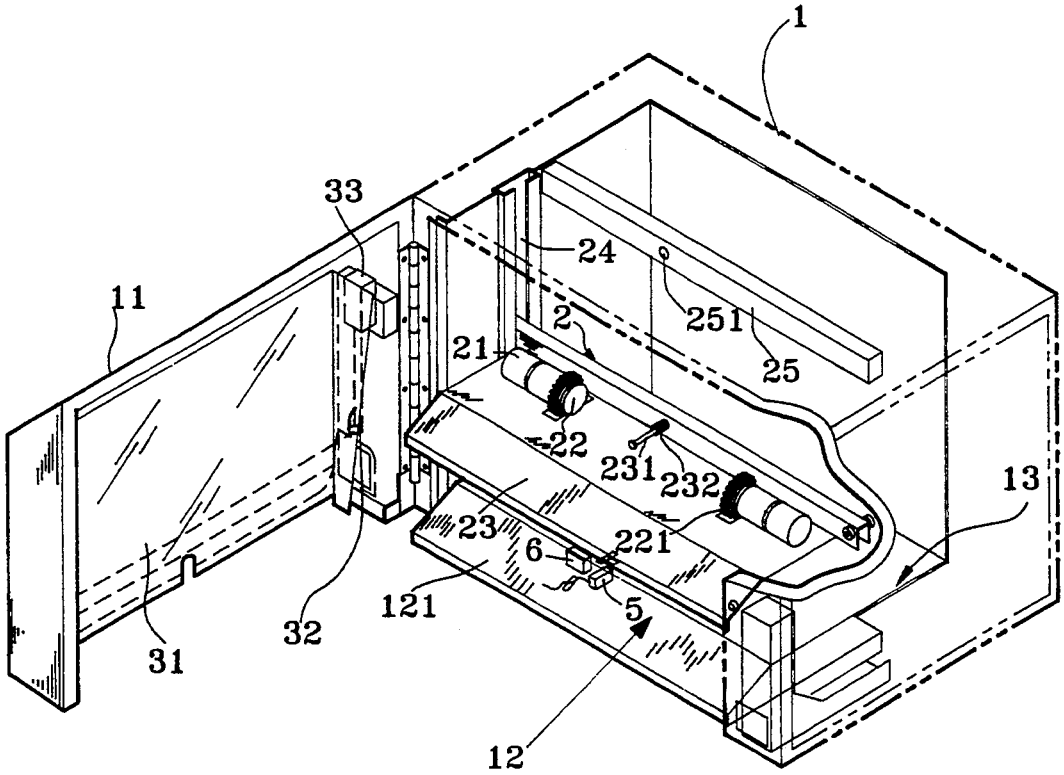
FIG. 2 is a perspective view of an alternate form of the newspaper vending machine of the present invention.
Figure 3:
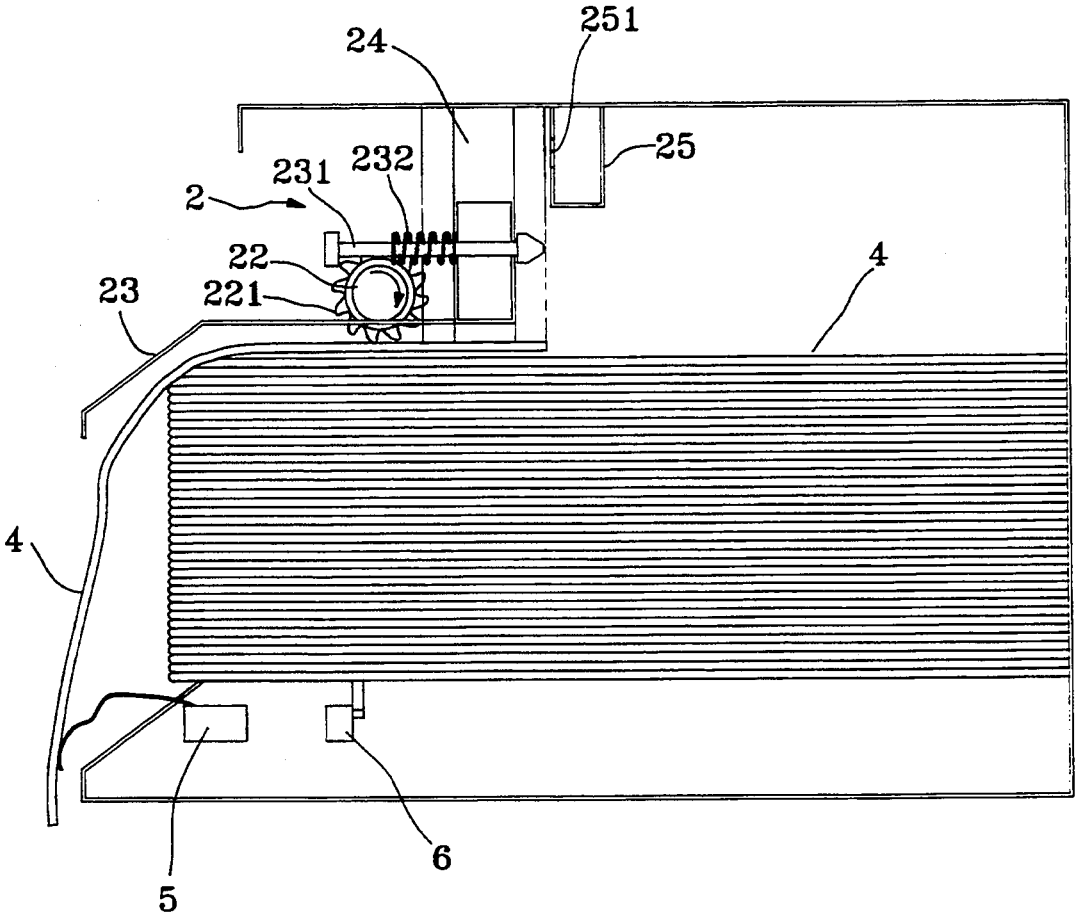
FIG. 3 is a side plain view of the newspaper vending machine showing one copy of the newspaper sent out by the gyrostate of the propeller mechanism of the newspaper let-off mechanism.

Referring to FIG. 1 again, the newspaper let-off mechanism 2 further comprises two vertical tracks 24 at two opposite sides, an impression board 23 controlled to move up and down along the vertical tracks 24, onto which the aforesaid motor 21 and gyrostate 22 are mounted, and a cross beam 25 disposed inside the cabinet 1 at the top. The motor 21 and the gyrostate 22 form a propeller mechanism. The gravity of the propeller mechanism gives a downward pressure to the impression board 23 causing it to constantly press the stack of copies of the respective kind of newspaper in the storage chamber 13. The gyrostate 22 has teeth 221 around the periphery disposed in a hole (not shown) on the impression board 23 and engage into the surface of the topmost copy of the newspaper 4 in the storage chamber 13 (see FIG. 3). When the motor 21 is turned on, the gyrostate 22 is turned round and round causing the teeth 221 to move the topmost copy of the newspaper out of the newspaper outlet 12. As the teeth 221 slightly engage into the surface of the topmost copy of the newspaper, they do not pierce through the topmost page of the topmost copy of the newspaper, and the topmost copy of the newspaper can be accurately sent out of the newspaper outlet 12 when the motor 21 is turned on. As an alternate form of the present invention, two propeller mechanisms may be installed in the cabinet 1 of the newspaper vending machine (see FIG. 2).

Figure 4:
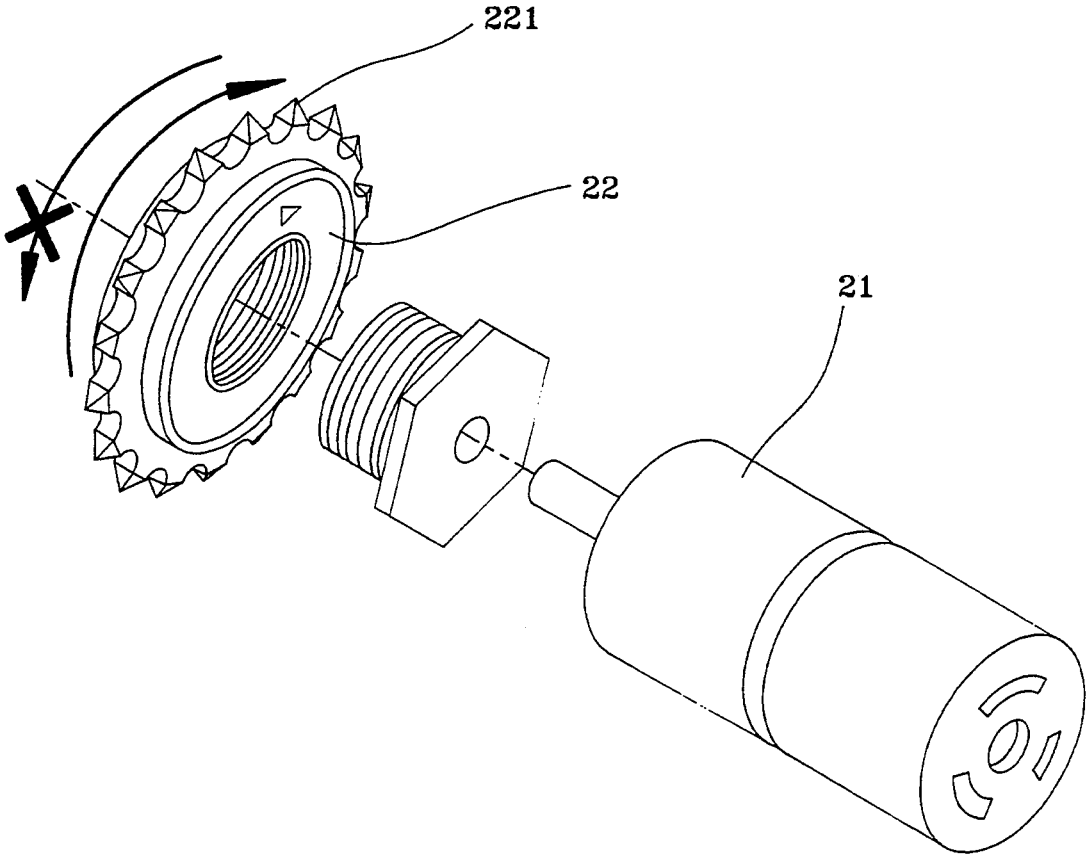
FIG. 4 is an exploded view of the gyrostate and motor of the propeller mechanism.

Referring to FIG. 4, the gyrostate 22 is allowed to be turned in one direction only. When the motor 21 is stopped, the inertial force keeps the gyrostate 22 to turn in idle without damaging the newspaper 4. When one copy of the newspaper 4 is being sent out halfway in the newspaper outlet 12 (See FIG. 3), an induction switch 5 (which can be a solenoid or photoelectric switch) will be triggered to stop the motor 21 within a fixed period, and at the same time the rear part of the copy of the newspaper 4 is still pressed by the teeth 221 of the gyrostate 22. When the purchaser pulls the copy of the newspaper 4 outward, the teeth 221 of the gyrostate 22 will be moved causing the gyrostate 22 to turn in idle. Therefore, the aforesaid design permits the gyrostate 22 to be turned in idle when the motor 21 is stopped so that the purchaser can pull out of the let-off copy of the newspaper without causing a damage.

Figure 5:
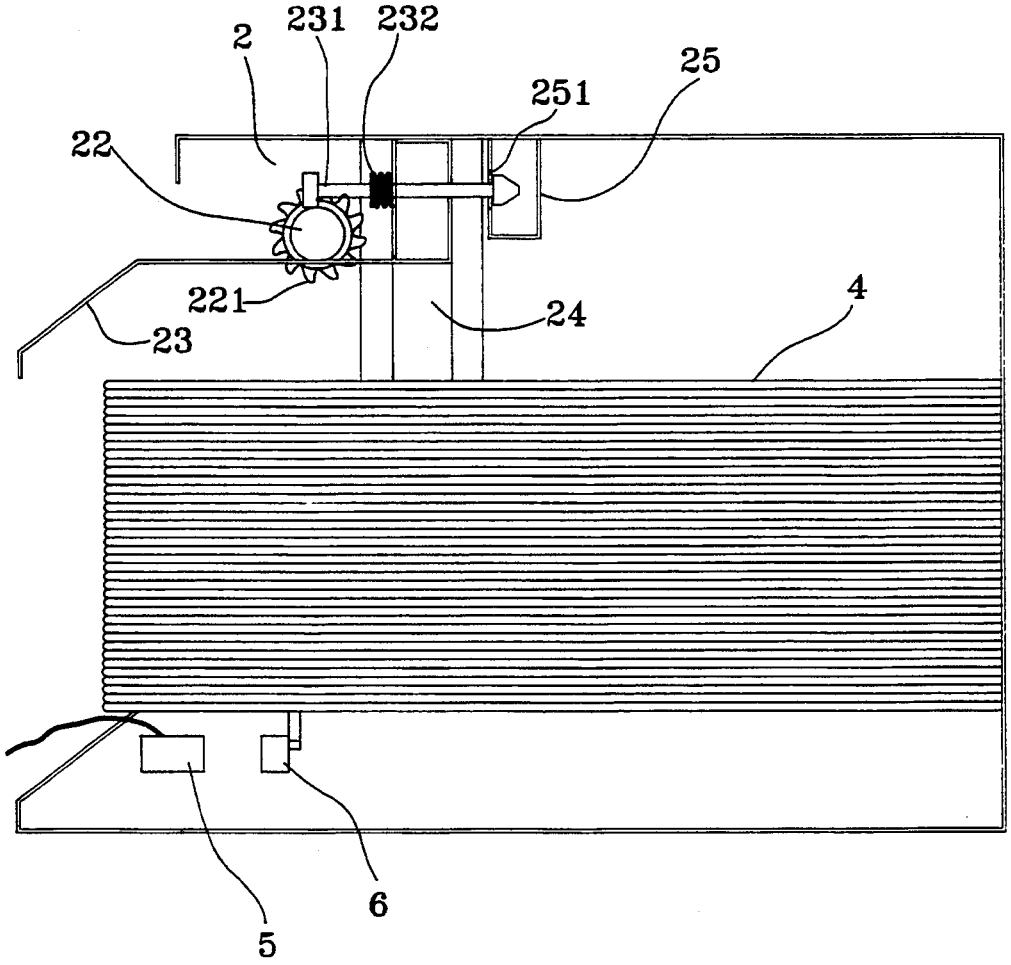
FIG. 5 is another side plain view of the newspaper vending machine showing the newspaper let-off mechanism locked in the non-operative position.

Referring to FIG. 5, the impression board 23 comprises a locating pin 231 supported on a spring 232 and having a hooked rear end releasably hooked in a through hole 251 on the cross beam 25. The diameter of the through hole 251 on the cross beam 25 is slightly bigger than the hooked rear end of the locating pin 231. When the hooked rear end of the locating pin 231 is hooked in the through hole 251 on the cross beam 25, the impression board 23 is disposed in the upper limit position inside the storage chamber 13 for allowing a stack of copies of the newspaper 4 to be loaded in the storage chamber 13. After the loading of the stack of copies of the newspaper 4, the impression board 23 is lifted causing the hooked rear end of the locating pin 231 to escape out of the through hole 251 on the cross beam 25, and therefore the impression board 23 can be pressed on the stack of copies of the newspaper 4.

Figure 6:
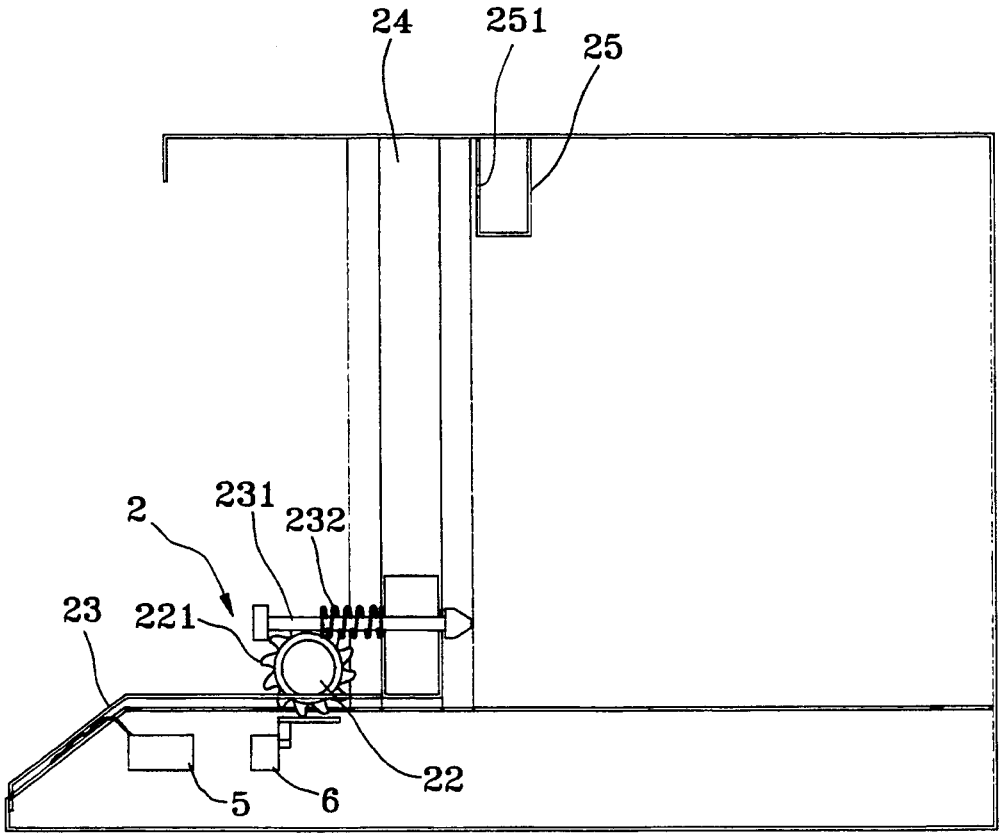
FIG. 6 shows an induction switch triggered by the newspaper let-off mechanism to stop the motor.

Referring to FIG. 6, an induction switch 6 is disposed inside the cabinet 12 at the bottom. The induction switch is triggered to shut off the motor 21 and simultaneously to turn on the sample copy release control mechanism 3, when a coin is dropped in after the stack of copies of the newspaper in the storage chamber 13 have been sold out, causing the sample copy release control mechanism 3 to release the sample copy 7.

Figure 8:
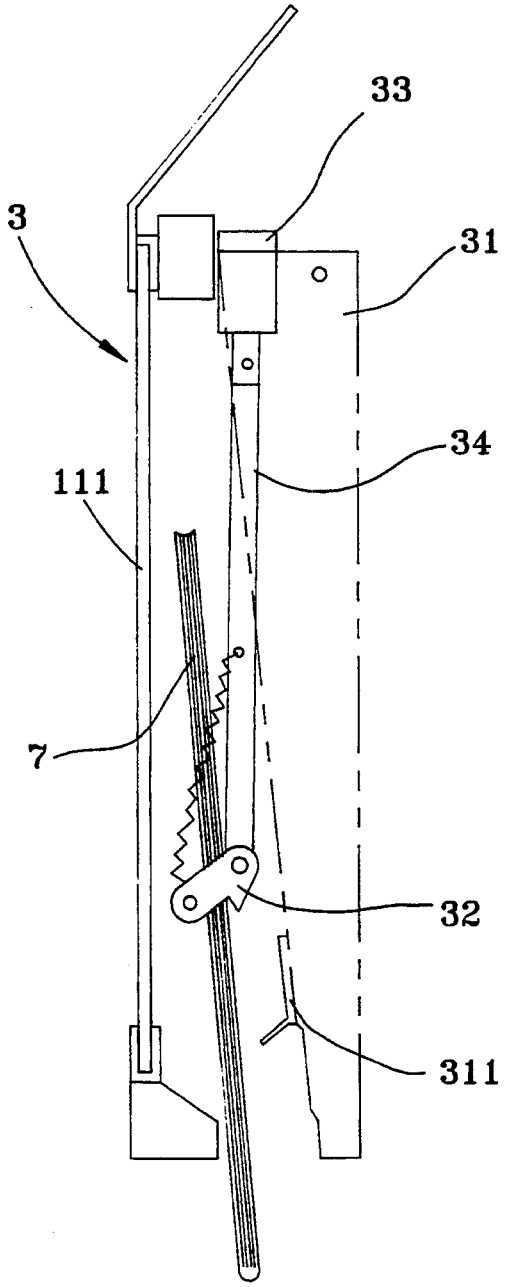
FIG. 8 is similar to FIG. 7 but showing the movable sample copy retaining plate released from the locating hook and the sample copy of the newspaper released from the sample copy retaining plate.

Referring to FIGS. 7 and 8 and FIG. 1 again, the sample copy release control mechanism 3 is comprised of an electromagnetic actuator 33, a link 34, the aforesaid locating hook 32, and the aforesaid movable sample copy retaining plate 31. The sample copy 7 is retained between the transparent door face 111 and the movable sample copy retaining plate 31 so that the banner-head line of the sample copy 7 is viewed through the transparent door face 111. The top of the movable sample copy retaining plate 31 is hinged to the front door 11, having a transverse stop strip 311 at the bottom to carry the sample copy 7. The locating hook 32 is pivoted to the link 34 at the bottom and releasably hooked on the transverse stop strip 311 to hold it in a position deviated from its center of gravity for permitting the sample copy 7 to be carried on the transverse stop strip 311. When the locating hook 32 is released from the transverse stop strip 311, the movable sample copy retaining plate 31 immediately returns to its former position causing the sample copy 7 to slip from the transverse stop strip 311 and to fall to the sloping guide 121 in the newspaper outlet 12. The release of the locating hook 32 is controlled by the electromagnetic actuator 33 via the link 34. When a coin is dropped in after all copies of the newspaper in the storage chamber 13 have been sold out, the electromagnetic actuator 33 will be triggered to move the link 34 causing the locating hook 32 to release the movable sample copy retaining plate 34 for letting the sample copy 7 to fall to the newspaper outlet 12. The loading of the sample copy 7 is simple. When the sample copy 7 is placed on the transverse stop strip 311 and disposed between the movable sample copy retaining plate 31 and the transparent door face 111, the movable sample copy retaining plate 31 is pushed toward the transparent door face 111 causing the locating hook 32 to hook on the transverse stop strip 311, and therefore the movable sample copy retaining plate 31 is retained in the sample copy holding position to hold the sample copy 7 in place.

Figure 9:
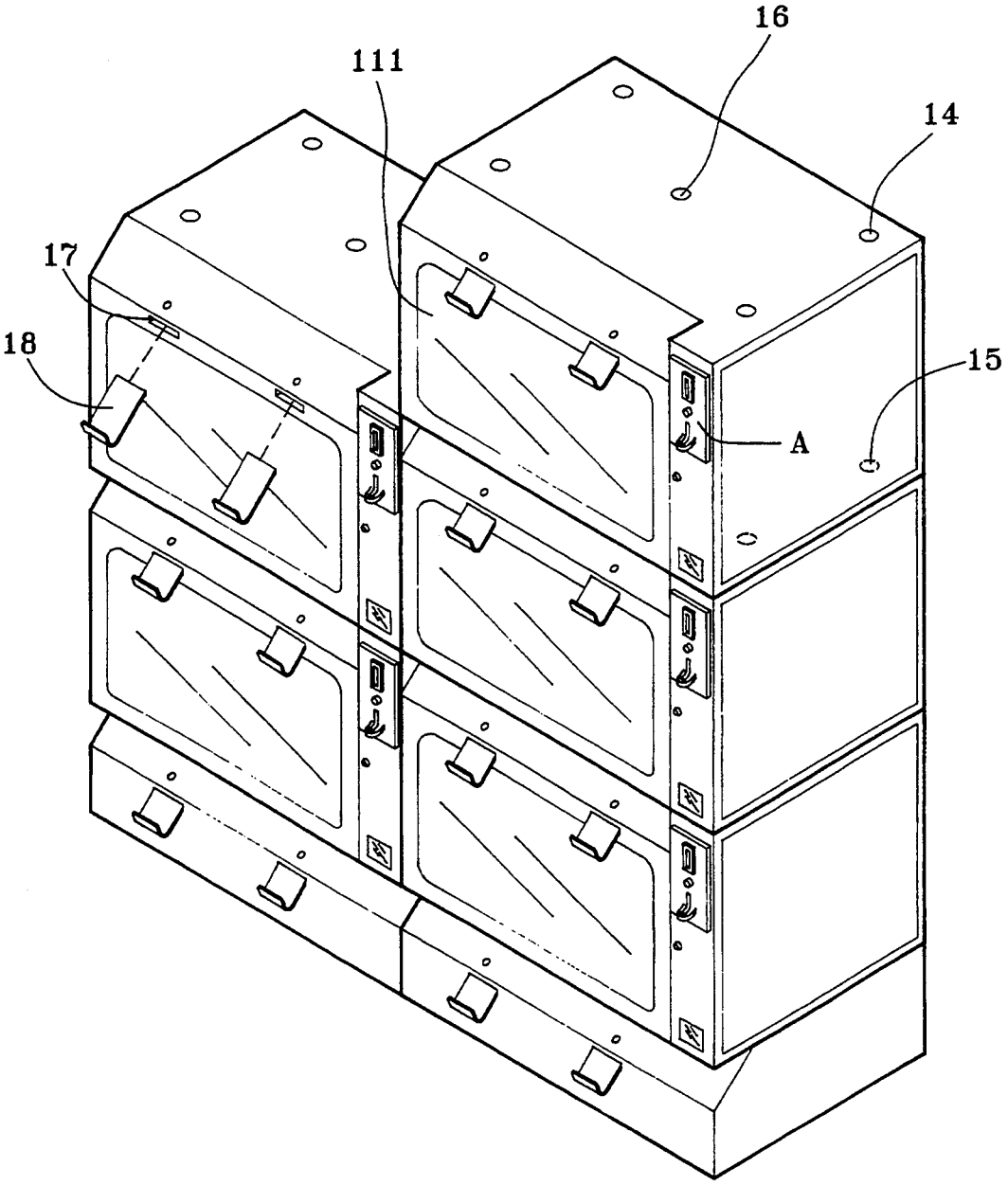
FIG. 9 shows a plurality of newspaper vending machines arranged together horizontally as well as vertically.

Referring to FIG. 9 again, the cabinet 1 of the newspaper vending machine comprises a plurality of recesses 14 spaced at the top and a plurality of raised portions 15 spaced at the bottom. By fitting the raised portions 15 on one vending machine into the recessed 14 on another, a plurality of vending machines of the same structure can be connected together in a stack. A screw hole (not shown) and a through hole 16 are respectively made on the cabinet 1 at different elevations so that two vending machines of the same structure can be fastened together by a screw bolt. The newspaper vending machine further comprises a plurality of racks 18 respectively mounted on respective plug holes 17 on the cabinet 1 for carrying the copy of the newspaper being sent out.

As indicated, the present invention provides a newspaper vending machine which automatically sends out one copy of the selected newspaper when a coin is dropped in. While only one embodiment of the present invention has been shown and described, it will be understood that various modifications and changes could be made without departing from the spirit and scope of the invention.

What is claimed is:

1. A newspaper vending machine comprising a cabinet having a transparent front door, a newspaper outlet disposed below said transparent front door, a sloping guide disposed in said newspaper outlet at the bottom, a storage chamber on the inside for keeping a stack of copies of a newspaper, a coin slot, a newspaper let-off mechanism, which automatically carry the topmost copy of the newspaper out of said newspaper outlet when a coin is dropped in said coin slot, and a sample copy release control mechanism, which automatically release a sample copy of the newspaper when a coin is dropped in said coin slot after the copies of the newspaper in said storage chamber have been sold out, wherein:

said newspaper let-off mechanism comprises two vertical tracks bilaterally disposed in said storage chamber, an impression board controlled to move up and down along said vertical tracks and pressed on the stack of copies of the newspaper being loaded in said storage chamber, at least one propeller mechanism mounted on said impression board and triggered to send the topmost copy of the newspaper out of said newspaper outlet when a coin is dropped in said coin slot, each propeller mechanism comprising one motor and one toothed one-way gyrostate disposed in a hole on said impression board and pressed on the stack of copies of the newspaper at the top, said toothed one-way gyrostate being turned to move the topmost copy of the stack of copies of the newspaper out of said newspaper outlet when a coin is dropped in said coin slot to turn on said motor;

said sample copy release control mechanism comprises a movable sample copy retaining plate hinged to said transparent front door on the inside to hold a sample copy of the newspaper for permitting the banner-head line of the sample copy of the newspaper to be shown through said transparent front door, an electromagnetic actuator mounted on said transparent front door, a link having a top end connected to said electromagnetic actuator and a bottom end terminating in a locating hook releasably hooked on said movable sample copy retaining plate, and an induction switch mounted inside said cabinet at the bottom, said induction switch being triggered to turn off said motor and simultaneously to turn on said sample copy release control mechanism permitting the sample copy of the news paper to be send out of said newspaper outlet when a coin is dropped in said coin slot after the stack of copies of the newspaper in said storage chamber have been sold out.

2. The newspaper vending machine of claim 1 wherein said newspaper let-off mechanism further comprises an inductor switch disposed in said newspaper outlet, which is triggered to turn off said motor when one copy of the newspaper is sent out of said newspaper outlet.

* * * * *